US008117681B2

(12) United States Patent
Aguila

(10) Patent No.: US 8,117,681 B2
(45) Date of Patent: Feb. 21, 2012

(54) FOLDING DEVICE FOR MALE CHILD URINATION

(76) Inventor: Wilfred Aguila, Tampa, FL (US)

( * ) Notice: Subject to any disclaimer, the term of this patent is extended or adjusted under 35 U.S.C. 154(b) by 0 days.

(21) Appl. No.: 13/181,554

(22) Filed: Jul. 13, 2011

(65) Prior Publication Data

US 2011/0265256 A1 Nov. 3, 2011

Related U.S. Application Data

(63) Continuation of application No. 12/243,646, filed on Oct. 1, 2008, now Pat. No. 7,996,926.

(51) Int. Cl.
*A47K 11/00* (2006.01)

(52) U.S. Cl. ..... 4/144.1; 4/144.2; 4/342; 493/960; 493/405

(58) Field of Classification Search ..... 4/144.2, 4/144.1, 144.4, 300.3, 340, 341, 342, 462, 4/463, 454, 902; 493/162, 356, 405, 408, 493/409, 960

See application file for complete search history.

(56) References Cited

U.S. PATENT DOCUMENTS

| | | | |
|---|---|---|---|
| 1,359,773 | A | 11/1920 | Weckbaugh |
| 1,857,328 | A | 5/1932 | Piper |
| 2,491,799 | A | 12/1949 | Clarke |
| 2,716,244 | A | 8/1955 | Wendel |
| 2,878,486 | A | 3/1959 | Bartlett et al. |
| 3,200,415 | A | 8/1965 | Breece, Jr. |
| 3,406,690 | A | 10/1968 | Gel et al. |
| 3,572,318 | A | 3/1971 | Garland |
| 4,067,336 | A | 1/1978 | Johnson |
| 4,182,334 | A | 1/1980 | Johnson |
| 4,198,900 | A | 4/1980 | Stone |
| 4,716,602 | A | 1/1988 | Brickhouse |
| D319,304 | S | 8/1991 | Johnson |
| 5,065,459 | A | 11/1991 | Tjahaja et al. |
| 5,129,111 | A | 7/1992 | Feinzilberg |
| 5,148,553 | A | 9/1992 | Jermann |
| 6,151,972 | A | 11/2000 | Venter et al. |
| 6,209,142 | B1 | 4/2001 | Mattsson |
| 6,327,716 | B1 | 12/2001 | Kaus |
| 6,473,911 | B2 | 11/2002 | Weiss |
| 6,968,578 | B2 | 11/2005 | Bernsley |
| 7,086,097 | B2 | 8/2006 | Shin |
| 7,171,699 | B2 | 2/2007 | Ernest |
| 7,334,273 | B2 | 2/2008 | Thomas |
| 2003/0125181 | A1 | 7/2003 | Wei |
| 2004/0181862 | A1 | 9/2004 | Brummer et al. |
| 2005/0066431 | A1 | 3/2005 | Liggieri |
| 2007/0151009 | A1 | 7/2007 | Conrad, III et al. |
| 2007/0234471 | A1 | 10/2007 | Walker et al. |

FOREIGN PATENT DOCUMENTS

| | | | |
|---|---|---|---|
| JP | 2003-260009 | A | 9/2003 |
| WO | 2000-025648 | A | 5/2000 |

*Primary Examiner* — Robert Canfield
*Assistant Examiner* — Babajide Demuren
(74) *Attorney, Agent, or Firm* — Larson & Larson, P.A.; Frank Liebenow; Justin Miller

(57) ABSTRACT

A foldable, hanging urinal includes a back surface, hooks and a receptacle. The foldable hanging urinal folds flat for transportation, inventory and disposal. Hooks on the back of the foldable hanging urinal fold out and the foldable hanging urinal hangs on a toilet fixture. The receptacle folds out to form a cup during use and the cup is positioned at a height lower than the rim of the toilet fixture thereby enabling urination by a person that is too short to reach the rim of the toilet fixture.

16 Claims, 5 Drawing Sheets

FOLDING DEVICE FOR MALE CHILD URINATION

CROSS-REFERENCE TO RELATED APPLICATION

This application is a continuation of to U.S. patent application Ser. No. 12/243,646, filed Oct. 1, 2008, the disclosure of which is hereby incorporated by reference.

FIELD OF THE INVENTION

This invention relates to the field of disposable portable urinals for children and more particularly to a disposable portable urinal for a male child that hangs on a toilet facility.

BACKGROUND

Children are often trained to urinate in a toilet at a very young age, usually between one year and three years of age. Often, a child of such an age, especially a boy child, cannot reach the standard plumbing fixtures. This is especially true while traveling.

At home, often, the child has a small potty seat designed for the child's size or a stool that the child can stand upon while utilizing the adult toilet. These aides are often not available when traveling or visiting friends and relatives.

U.S. Pat. No. 5,158,553 to Jermann proposes a child's urinal that hangs from the side of a standard toilet. This device functions well at home, but does not fold and would not be useful for travel such as when used for public restrooms or when visiting fiends and relatives. Additionally, it has to be cleaned after each use.

U.S. Pat. No. 7,086,097 to Shin proposes a disposable urinal for a child that can be folded into a small package and easily carried. This device does not have hooks and is not intended to overhang an existing toilet or urinal and therefore must be held or placed atop another fixture while the child urinates, creating a mess due to any splashes or a miss.

What is needed is a child's urinal that is portable, disposable and hangs onto the side of a toilet or urinal.

SUMMARY OF THE INVENTION

A foldable, hanging urinal includes a back surface, hooks and a receptacle. The foldable hanging urinal is preferably made from planar cardboards stock and folds flat for transportation, inventory and disposal. Hooks on the back of the foldable hanging urinal fold out for hanging the foldable hanging urinal on a toilet fixture. The receptacle folds out to form a cup to accept urine.

In one embodiment, a foldable hanging urinal is disclosed including a back shield with two hooks hingedly interfaced to its back surface. A foldable receptacle is interfaced to a front surface of the back shield. The foldable receptacle is open at a top end for accepting urine and is closed and water tight at a bottom end for holding the urine. When in use, the foldable hooks fold out and hook over an edge of a toilet/urinal and the foldable receptacle is extended and located at a point lower than the edge of the toilet/urinal to facilitate urination by a user who is not tall enough to reach over the edge of the toilet/urinal. When not in use, the two foldable hooks fold flat against the rear surface of the back shield and the foldable receptacle folds flat against the front surface of the back shield for carrying, transportation, stocking, etc.

In another embodiment, a foldable hanging urinal is disclosed including a back shield having two hooks hingedly interfaced to a back surface. A receptacle on the front surface of the back shield has a top lip and has a water-tight base for holding urine. When in use, the hooks have an open configuration in which the hooks extend from the back surface of the back shield and the hooks removably attach the foldable hanging urinal over an edge of a toilet/urinal and, therefore, the receptacle is positioned at a point lower than the edge of the toilet/urinal to facilitate urination by a person too short to reach the edge of the toilet/urinal. When not in use, the hooks have a closed configuration in which the hooks fold flat against a back surface of the back shield.

In another embodiment, a foldable hanging urinal is disclosed including a back shield made from planar cardboard stock and two hooks also made from the planar cardboard stock. The two hooks are hingedly interfaced to the back section by folds between the hooks and the back section. A receptacle is formed from folded planar cardboard stock and is attached to a front surface of the back shield. The receptacle has an open upper rim and a closed, water-tight base for holding urine. When in use, the hooks hold the foldable hanging urinal over a rim of a toilet/urinal and the open upper rim of the receptacle is at a lower position than the rim of the toilet. When not in use, the hooks and the receptacle have a folded position in which the hooks lay flat against the back section of the back shield and the receptacle lays flat against the front surface of the back shield.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
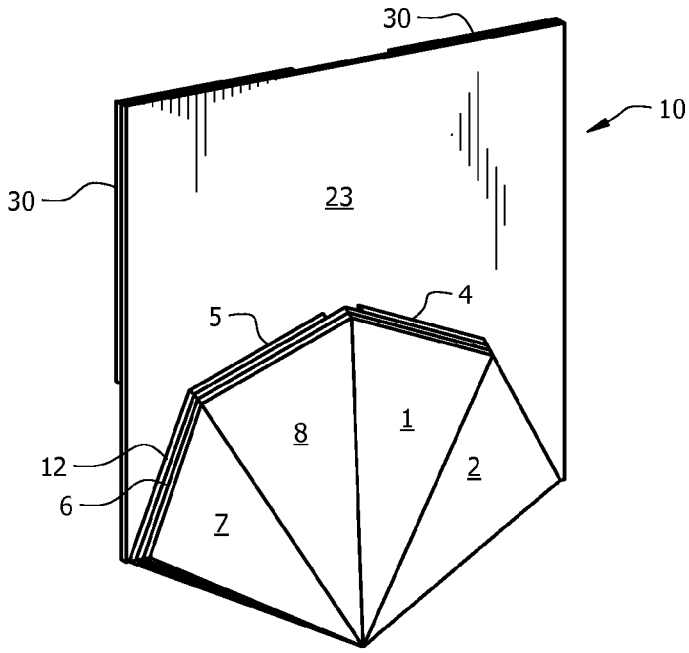
FIG. 1 illustrates a perspective view of the present invention in a folded configuration.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a perspective view of the present invention is shown in a folded configuration. The foldable hanging urinal 10 has a back shield 23. A receptacle 20 (see FIG. 2) for capturing a flow of urine is shown flat against the back shield 23 exposing the outside surface of the receptacle's front panels 1/2/7/8. The rear panels 3/4/5/6 of the receptacle 20 are shown folded between the back shield 23 and the front panels 1/2/7/8. Two hooks 30 are hingedly interfaced to a back surface of the back shield 23 and are shown folded against a back surface of the back shield 23. Preferably, the foldable hanging urinal 10 is made from a cardboard stock that is coated with a water shield to prevent the cardboard stock from degrading and leaking when exposed to the child's urine. In some embodiments, both sides of the cardboard stock are coated with the water shield while in other embodiments, only one side of the cardboard stock are coated with the water shield (the side outwardly exposed).

The folded configuration is useful for transportation, disposal, distribution, etc. As will be shown with FIG. 5, the foldable hanging urinal 10 is made from a single sheet of cardboard stock.

Figure 2:
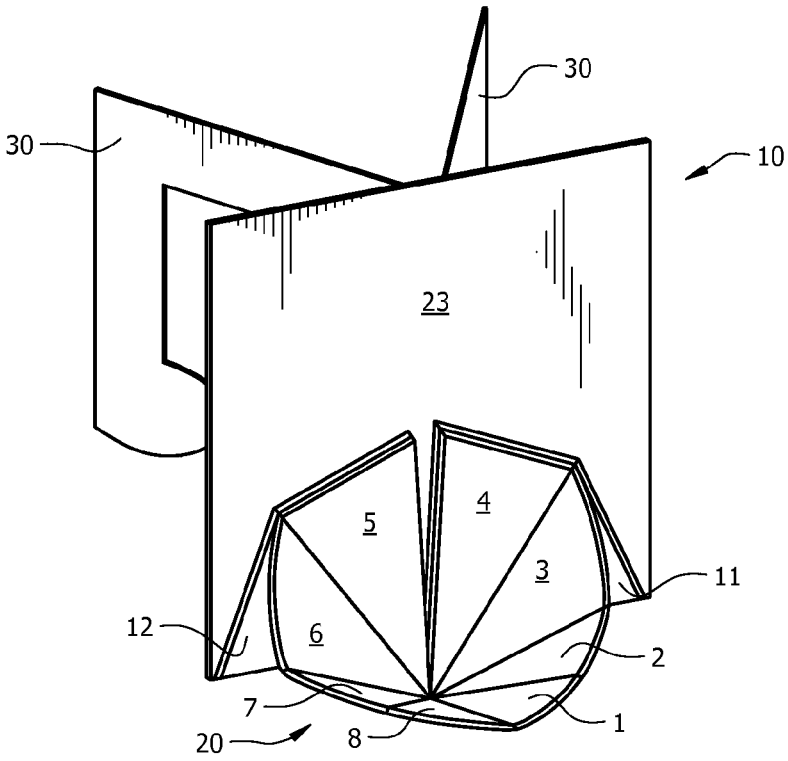
FIG. 2 illustrates a perspective view of the present invention in an open configuration.
Figure 3:
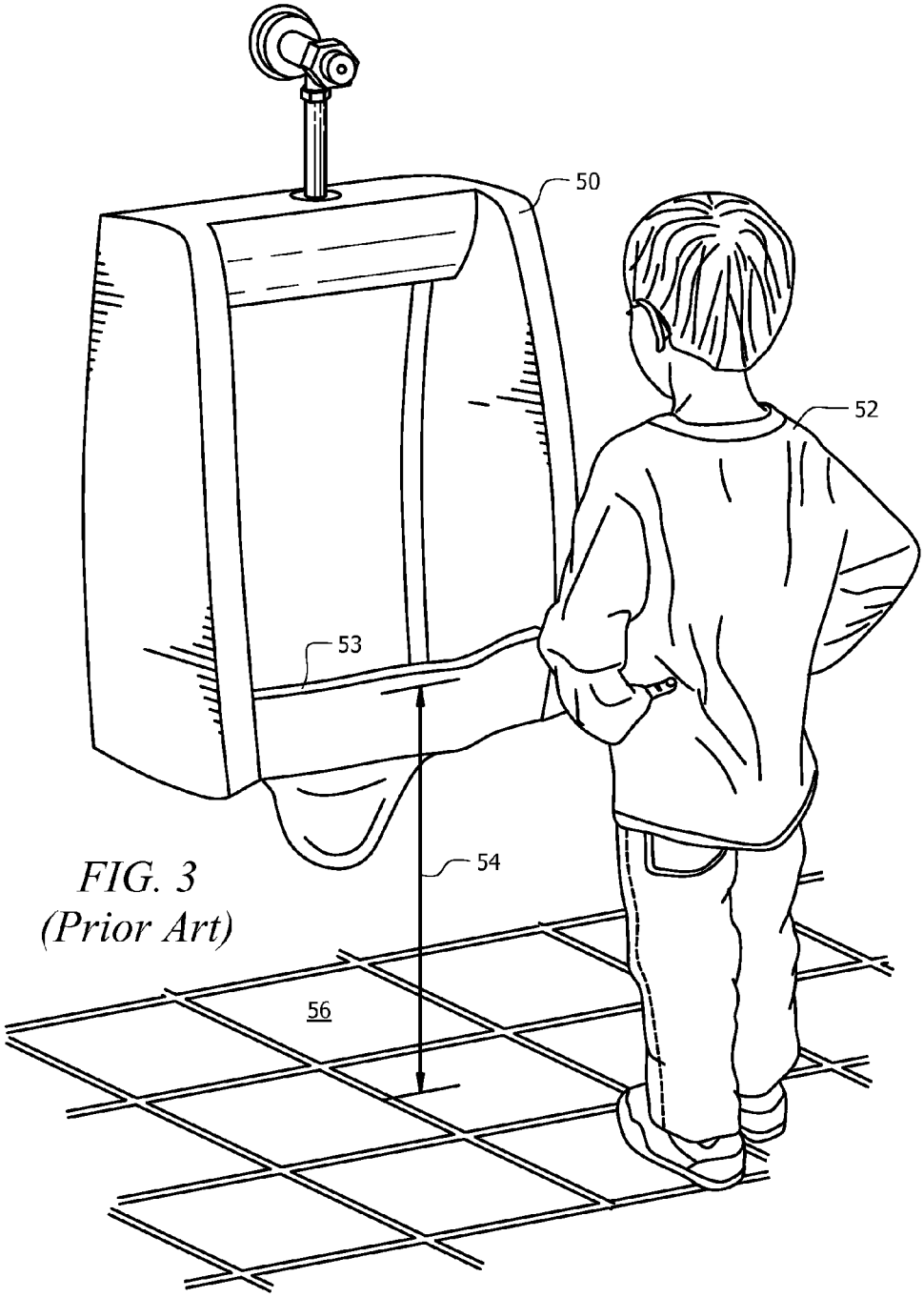
FIG. 3 (Prior Art)
FIG. 3 illustrates a men's urinal of the prior art.
Figure 4:
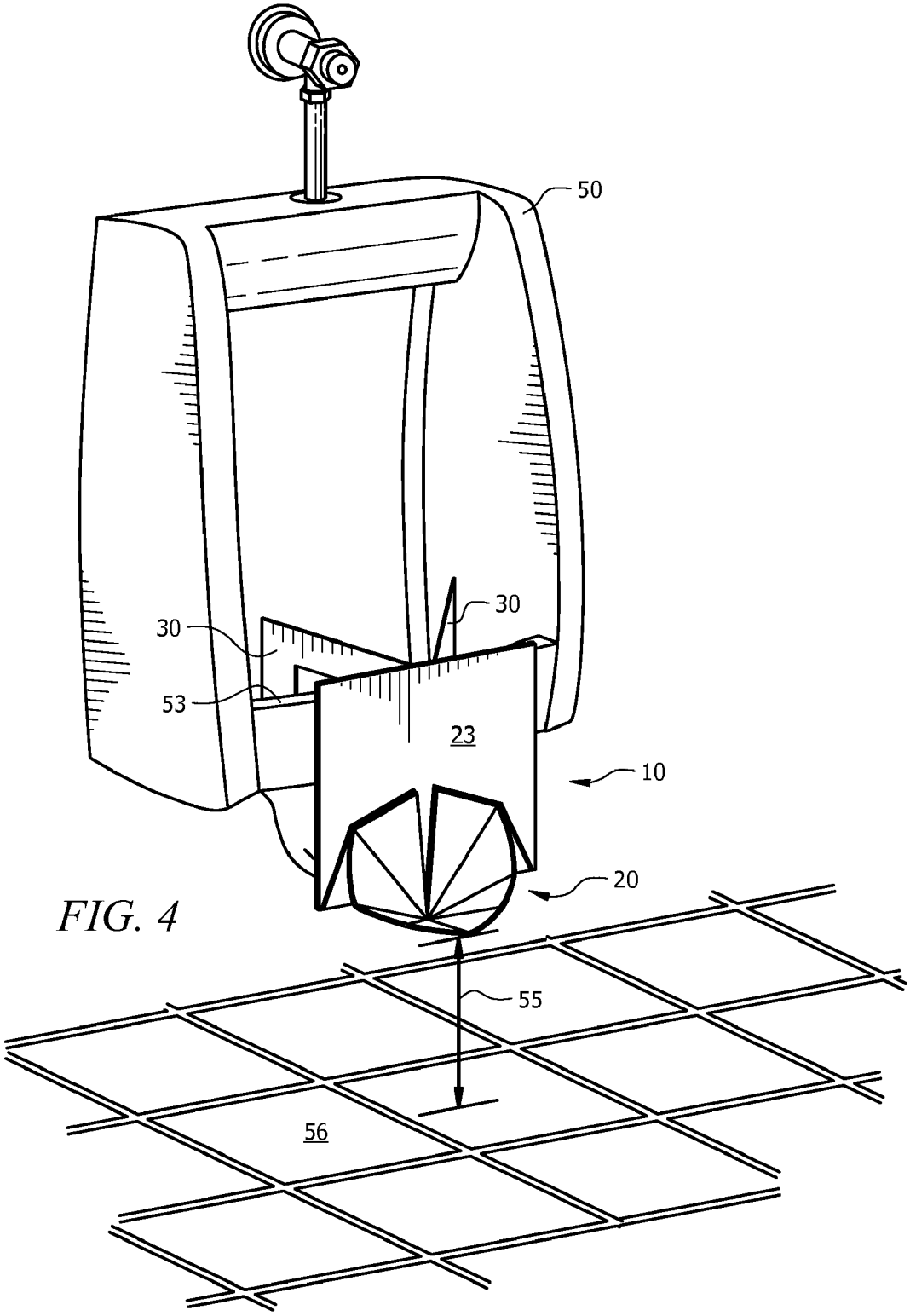
FIG. 4 illustrates a perspective view of the present invention attached to the urinal of the prior art.

Referring to FIG. 2, a perspective view of the present invention is shown in an open configuration. The foldable hanging urinal 10 has a back shield 23. A receptacle 20 for capturing a flow of urine is interfaced to the back shield 23 and two hooks 30 are interfaced to a back surface of the back shield 23 for hanging the foldable hanging urinal 10 on a rim of a toilet (not shown) or front of a urinal 50 (as shown in FIGS. 3 and 4). Preferably, the foldable hanging urinal 10 is made from a cardboard stock that is coated with a water shield to prevent the cardboard stock from degrading and leaking when exposed to the child's urine. In some embodiments, both sides of the cardboard stock are coated with the water shield while in other embodiments, only one side of the cardboard stock is coated with the water shield (the side outwardly exposed).

The receptacle 20 is formed by panels of the cardboard stock. The panels 1/2/3/4/5/6/7/8 of the receptacle 20 are folded to extend the receptacle 20. The face surfaces of the inner sides 11/12 of the receptacle 20 are affixed to the face surface of the back shield 23. The back surface of the rear-most sides 4/5 of the receptacle 20 are affixed to the back surface of the inner sides 11/12.

The hooks 30 fold out from the back surface of the back shield 23 and the receptacle 20 folds out from the front surface of the back shield 23. As will be shown with FIG. 6, the foldable hanging urinal 10 is made from a single sheet of cardboard stock.

Referring to FIG. 3, a urinal of the prior art is shown. The urinal 50 is similar to a urinal normally found in public men's rooms. For very young boys 52, the height 54 from the floor 56 to the lip 53 of the urinal 50 is often too high for the young boy 52 to urinate into the urinal 50.

Referring to FIG. 4, a perspective view of the present invention attached to the urinal 50 is shown. The foldable hanging urinal 10 is hung over the lip 53 of the urinal 50 with the hooks 30. The receptacle 20 is facing outward and low enough to accept a stream of urine (not shown) from the young boy 52 (see FIG. 2). As shown, the distance 55 from the floor 56 to the receptacle 20 is less than the distance 54 (see FIG. 3) from the floor 56 to the lip of the urinal 53. After urination, the foldable hanging urinal 10 is lifted and turned into the urinal 50 to dispose of the urine and then the foldable hanging urinal 10 is discarded.

Figure 4A:
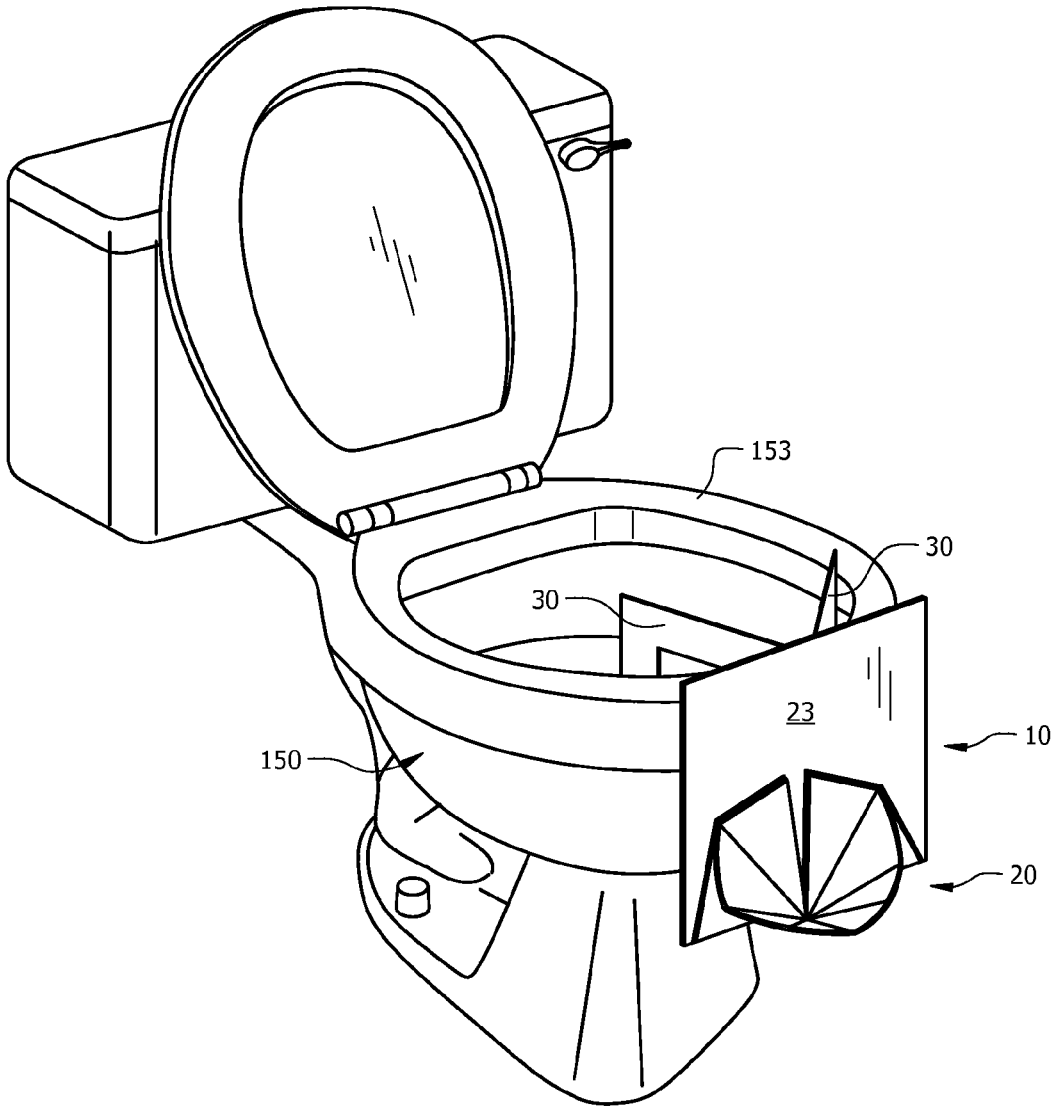
FIG. 4A illustrates a perspective view of the present invention attached to the toilet of the prior art.

Referring to FIG. 4A, a perspective view of the present invention attached to the toilet 150 is shown. The foldable hanging urinal 10 is hung over the edge 153 with the hooks 30. The receptacle 20 is facing outward and low enough to accept a stream of urine (not shown) from the young boy 52 (see FIG. 2). After urination, the foldable hanging urinal 10 is lifted and turned into the toilet 150 to dispose of the urine and then the foldable hanging urinal 10 is discarded.

Figure 5:
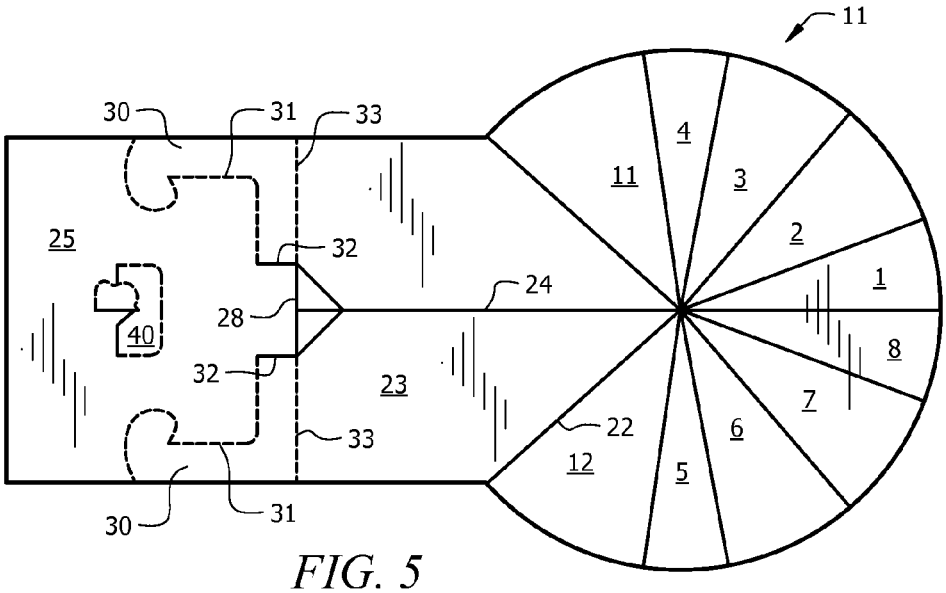
FIG. 5 illustrates a plan view of an embodiment of the present invention before assembly.

Referring to FIG. 5, a plan view of an embodiment of the present invention before assembly is shown. In a preferred embodiment, the foldable hanging urinal 10 is made from a contiguous, flat sheet of cardboard stock 11 as shown in FIG. 5. The flat sheet of cardboard stock 11 is cut, folded and glued into the shape shown in FIGS. 1, 2 and 4. Any known method of cutting, folding and gluing (adhering) is anticipated.

The receptacle 20 is formed by creasing the cardboard stock 11 at receptacle fold lines between each of the front panels 1/2/7/8, rear panels 3/6 and end panels 4/5 of the receptacle 20. The inner panels 11/12 interface to the back panel at back panel fold lines 22 and are folded at the fold lines 22 so the face surface of the inner panels 11/12 lay against the face surface of the back shield 23. The face surface of the inner panels 11/12 is adhered to the face surface of the back shield 23. The rear-most or end panels 4/5 of the receptacle 20 interface to the inner panels 11/12 at intermediate fold lines and are folded so the back of the end panels 4/5 lay against the back of the inner panels 11/12. The backs of the end panels 4/5 are adhered to the back of the inner panels 11/12. In a preferred embodiment, a center fold line 24 assists in forming the receptacle 20 when in use.

The hooks 30 are formed by cutting the cardboard stock 11 at cut lines 31/33. The hooks 30 hinge from the back section 25 along a fold line 32.

The back section 25 is folded along a fold line 28 allowing the back of the back section 25 to interface with the back of the back shield 23 and the back of the back section 25 is adhered to the back of the back shield 23.

In some embodiments, a catch 40 formed by folding out the catch 40 from the back section 25. When present, the catch 40 helps keep the foldable hanging urinal 10 from lifting off of the urinal 50 while in use.

It is known in the industry how to pre-cut and pre-crease cardboard stock 11 such that the cardboard stock 11 is easily bent, folded, separated and glued into the foldable hanging urinal 10. Although any cardboard stock material is acceptable, it is preferred that the face of the cardboard stock 11 be coated with a water-resistant coating to enhance urine retention. In some embodiments, both the face and the back of the cardboard stock 11 are coated with a water resistant coating.

Figure 6:
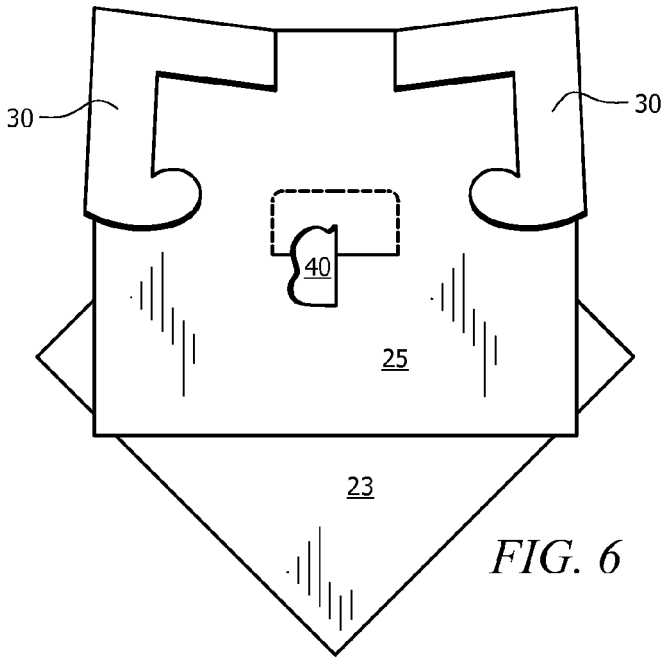
FIG. 6 illustrates a perspective view of the present invention from the rear.

Referring to FIG. 6, a perspective view of the present invention from the rear is shown. The back of the back section 25 and some of the back of the back shield 23 is visible. The hooks 30 are shown pulled slightly away from the back section 25 and the catch 40 is shown extending from the back section 25.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A foldable hanging urinal comprising:

a back shield;

two foldable hooks hingedly interfaced to a back surface of the back shield; and a foldable receptacle interfaced to a front surface of the back shield, a top end of the foldable receptacle retractably extends outwardly from the back shield for accepting urine and the foldable receptacle is closed and water tight at a bottom end for holding the urine, the foldable receptacle unfolds to form a cup;

whereas, the foldable hooks fold out and hook over an edge of a toilet/urinal and the foldable receptacle is extended and located at a point lower than the edge of the toilet/urinal to facilitate urination by a user who is not tall enough to reach over the edge of the toilet/urinal and whereas, the two foldable hooks also fold flat against the rear surface of the back shield and the foldable receptacle folds flat against the front surface of the back shield.

2. The foldable hanging urinal of claim 1, wherein the back shield, the two foldable hooks and the foldable receptacle are made from cardboard stock.

3. The foldable hanging urinal of claim 2, wherein a face of the cardboard stock is coated with a water resistant material.

4. The foldable hanging urinal of claim 3, wherein a back surface of the cardboard stock is coated with a water resistant material.

5. The foldable hanging urinal of claim 1, further comprising a catch formed on the back surface of the back shield, the catch spacing the back surface from the toilet/urinal.

6. A foldable hanging urinal comprising:

a back shield;

two hooks hingedly interfaced to a back surface of the back shield; and a foldable receptacle on a front surface of the back shield, the foldable receptacle having a rim, the foldable receptacle unfolds to form a cup and the receptacle having a water-tight base for holding urine;

wherein the hooks have two positions, a closed position in which the hooks lay flat against the back shield and an open position in which the hooks extend from the back surface of the back shield, whereas in the open position, the hooks removably attach the foldable hanging urinal over an edge of a toilet/urinal and the receptacle is located at a point lower than the edge of the toilet/urinal to facilitate urination by a person who is too short to reach the edge of the toilet/urinal.

7. The foldable hanging urinal of claim 6, wherein the back shield, the two hooks and the receptacle are made from cardboard stock.

8. The foldable hanging urinal of claim 7, wherein a face of the cardboard stock is coated with a water resistant material.

9. The foldable hanging urinal of claim 8, wherein a back surface of the cardboard stock is coated with a water resistant material.

10. The foldable hanging urinal of claim 6, further comprising a catch formed on the back surface of the back shield, the catch spacing the back surface of the back shield away from the toilet/urinal.

11. A foldable hanging urinal comprising:

a back shield made from planar cardboard stock;

two hooks made from the planar cardboard stock, the two hooks hingedly interfaced to the back section by folds between the hooks and the back section; and a receptacle, the receptacle formed from folded planar cardboard stock, the receptacle attached to a front surface of the back shield, the receptacle extendable from the back shield, the receptacle having an upper rim the foldable receptacle unfolds to form a cup with and a closed, water-tight base for holding urine;

wherein the hooks and receptacle have two modes of operation, a storage mode in which the hooks and receptacle lay flat against the back shield and a use mode in which the hooks and receptacle extend outwardly from the back shield and, whereas, the hooks extend outwardly from the back shield and hold the foldable hanging urinal over a rim of a toilet/urinal and the upper rim of the receptacle extends outwardly from the back shield at a lower position than the rim of the toilet thereby enabling urination by a person too short to reach the rim of the toilet/urinal.

12. The foldable hanging urinal of claim 11, wherein a face of the planar cardboard stock is coated with a water resistant material.

13. The foldable hanging urinal of claim 12, wherein a back surface of the planar cardboard stock is coated with a water resistant stock.

14. The foldable hanging urinal of claim 11, further comprising a catch formed on the back surface of the back shield, the catch spacing the back surface of the back shield away from the toilet/urinal.

15. The foldable hanging urinal of claim 11, wherein the back shield and the two hooks are made from a single sheet of the planar cardboard material.

16. The foldable hanging urinal of claim 11, wherein the back shield and the two hooks are made from two sheets of the planar cardboard material and the two hooks are affixed to the back surface of the back shield.

* * * * *